US009925765B2

(12) United States Patent
Taniyama

(10) Patent No.: US 9,925,765 B2
(45) Date of Patent: Mar. 27, 2018

(54) APPARATUS FOR EJECTING LIQUID

(71) Applicant: Masaki Taniyama, Kanagawa (JP)

(72) Inventor: Masaki Taniyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/369,984

(22) Filed: Dec. 6, 2016

(65) Prior Publication Data

US 2017/0157920 A1 Jun. 8, 2017

(30) Foreign Application Priority Data

Dec. 8, 2015 (JP) ..... 2015-239627
Oct. 21, 2016 (JP) ..... 2016-206955

(51) Int. Cl.
*B41J 29/38* (2006.01)
*B41J 2/045* (2006.01)

(52) U.S. Cl.
CPC ..... *B41J 2/04541* (2013.01); *B41J 2/04586* (2013.01); *B41J 2/04588* (2013.01)

(58) Field of Classification Search
CPC ..... B41J 2/04581; B41J 2/04588; B41J 2/14233; B41J 2/04541; B41J 2/161; B41J 2/04573; B41J 29/38; B41J 2/0458; B41J 2/04586
USPC ..... 347/9, 10, 11, 14, 17, 19, 68, 70
See application file for complete search history.

(56) References Cited

U.S. PATENT DOCUMENTS 7,794,034 B2 * 9/2010 Shingyohuchi ..... B41J 2/04588 347/10
2012/0320118 A1 * 12/2012 Yokomaku ..... B41J 2/04588 347/11
2015/0352841 A1 * 12/2015 Horie ..... B41J 2/04581 347/10

FOREIGN PATENT DOCUMENTS

| | | |
|---|---|---|
| JP | 11-020165 | 1/1999 |
| JP | 11-334072 | 12/1999 |
| JP | 2003-175601 | 6/2003 |
| JP | 2004-066727 | 3/2004 |
| JP | 2007-098820 | 4/2007 |
| JP | 2010-058385 | 3/2010 |
| JP | 2010-143020 | 7/2010 |
| JP | 2012-236393 | 12/2012 |
| JP | 2012-250477 | 12/2012 |

* cited by examiner

*Primary Examiner* — Jannelle M Lebron
(74) *Attorney, Agent, or Firm* — Harness, Dickey & Pierce, P.L.C.

(57) ABSTRACT

An apparatus for ejecting liquid, includes a liquid ejection head with a plurality of individual liquid chambers and a common liquid chamber, and a pressure generator to generate a pressure for pressing liquid in the individual liquid chambers. A pulse interval, which is a time from the end of a push-in waveform element of a preceding driving pulse to the start of a pull-in waveform element of a succeeding driving pulse in the two continuous driving pulses is set to a timing when a pressure difference among the pressure fluctuations in the individual liquid chambers, caused by the pressure fluctuation in the common liquid chamber, becomes smaller.

3 Claims, 18 Drawing Sheets

APPARATUS FOR EJECTING LIQUID

CROSS-REFERENCE TO RELATED APPLICATIONS

This patent application is based on and claims priority pursuant to 35 U.S.C. § 119A to Japanese Patent Application No. 2015-239627, filed on Dec. 8, 2015, and 2016-206955, filed on Oct. 21, 2016, in the Japan Patent Office, the entire disclosure of which is hereby incorporated by reference herein.

BACKGROUND

Technical Field

The present invention relates to an apparatus for ejecting liquid.

Description of the Related Art

In an apparatus that ejects liquid using a liquid ejection head, a technique of forming dots of a plurality of sizes by applying a plurality of driving pulses (ejection pulses) to a pressure generator in time series, by continuously ejecting a plurality of droplets, and by integrating a plurality of droplets during flight.

Conventionally, for example, there has been a configuration in which a driving waveform including a first driving pulse and a second driving pulse supplied to a pressure generator of a recording head in time series is generated and output within a single driving cycle. The first driving pulse at least includes a pull-in waveform element for expanding individual liquid chambers, and a push-in waveform element for contracting the expanded individual liquid chambers. The second driving pulse at least includes a pull-in waveform element for expanding the individual liquid chambers, and a push-in waveform element for contracting the expanded individual liquid chambers. The time from the end point of the push-in waveform element of the first driving pulse to the start point of the pull-in waveform element of the second driving pulse is an integer multiple of the natural vibration period of the individual liquid chambers.

Meanwhile, when driving a liquid ejection head in which a plurality of nozzles is arranged, if nozzles (meaning of nozzles for ejecting liquid) simultaneously driven increase, there is a problem of occurrence of difference between the ejection velocity of liquid ejected from the nozzle of a central portion of the nozzle row and the ejection velocity of liquid ejected from the nozzle of an end of the nozzle row, due to pressure interference and pressure fluctuation in the common liquid chamber.

SUMMARY

In one aspect to the invention, an apparatus for ejecting liquid, includes: a liquid ejection head including a plurality of nozzles to eject liquid, a plurality of individual liquid chambers to which each nozzle leads, a common liquid chamber to supply liquid to the plurality of individual liquid chambers, and a pressure generator to generate a pressure for pressing liquid in the individual liquid chambers; and a driving waveform generator to generate a driving waveform to be applied to the pressure generator of the liquid ejection head. The driving waveform includes a plurality of driving pulses which continuously ejects liquid in time series. Each driving pulse at least includes a pull-in waveform element which expands the individual liquid chambers, and a push-in waveform element which contracts the expanded individual liquid chamber to eject the liquid. A pulse interval is a time from the end of the push-in waveform element of a preceding driving pulse to the start of the pull-in waveform element of a succeeding driving pulse in the two continuous driving pulses. The pulse interval is set to a timing when a pressure difference among the pressure fluctuations in the individual liquid chambers, caused by the pressure fluctuation in the common liquid chamber, becomes smaller.

In another aspect of the invention, an apparatus for ejecting liquid, includes: a liquid ejection head including a plurality of nozzles to eject liquid, a plurality of individual liquid chambers to which each nozzle leads, a common liquid chamber to supply liquid to the plurality of individual liquid chambers, and a pressure generator to generate a pressure for pressing liquid in the individual liquid chambers; and a driving waveform generator to generate a driving waveform to be applied to the pressure generator of the liquid ejection head. The driving waveform includes a plurality of driving pulses which continuously ejects liquid in time series. $Tn=n\times Tc/2+x0$ is satisfied. Tn denotes the pulse interval, with n being a natural number, Tc denotes a natural vibration period of the individual liquid chambers, and x0 denotes the time from a first peak of pressure fluctuation in the individual liquid chambers caused by the preceding driving pulse to a first peak of residual pressure fluctuation in the individual liquid chambers due to pressure fluctuation in the common liquid chamber caused by the pressure fluctuation in the individual liquid chambers.

In another aspect of the invention, an apparatus for ejecting liquid, includes: a liquid ejection head including a plurality of nozzles to eject liquid, a plurality of individual liquid chambers to which each nozzle leads, a common liquid chamber to supply liquid to the plurality of individual liquid chambers, and a pressure generator to generate a pressure for pressing liquid in the individual liquid chambers; and a driving waveform generator to generate a driving waveform to be applied to the pressure generator of the liquid ejection head. The driving waveform includes at least three driving pulses which continuously eject liquid in time series. Each driving pulse at least includes a pull-in waveform element which expands the individual liquid chambers, and a push-in waveform element which contracts the expanded individual liquid chamber to eject the liquid. A time from the end of the push-in waveform element of a preceding driving pulse to the start of the pull-in waveform element of a succeeding driving pulse in the two continuous driving pulses is set as a pulse interval. Further, a natural vibration period of the individual liquid chambers is set as Tc, and the time from a first peak of pressure fluctuation in the individual liquid chambers caused by the preceding driving pulse to a first peak of residual pressure fluctuation of the individual liquid chambers due to pressure fluctuation in the common liquid chamber caused by the pressure fluctuation in the individual liquid chambers is set as x0. When the time obtained by $Tn=N\times Tc/2+x0$ (where, N is an integer) is set as a time $\Delta c$, and when at least two pulse intervals included in the driving waveform are set as Tn1 and Tn2, respectively, one of the two pulse intervals Tn1 and Tn2 is shorter than the time $\Delta c$, and the other thereof is longer than the time $\Delta c$.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
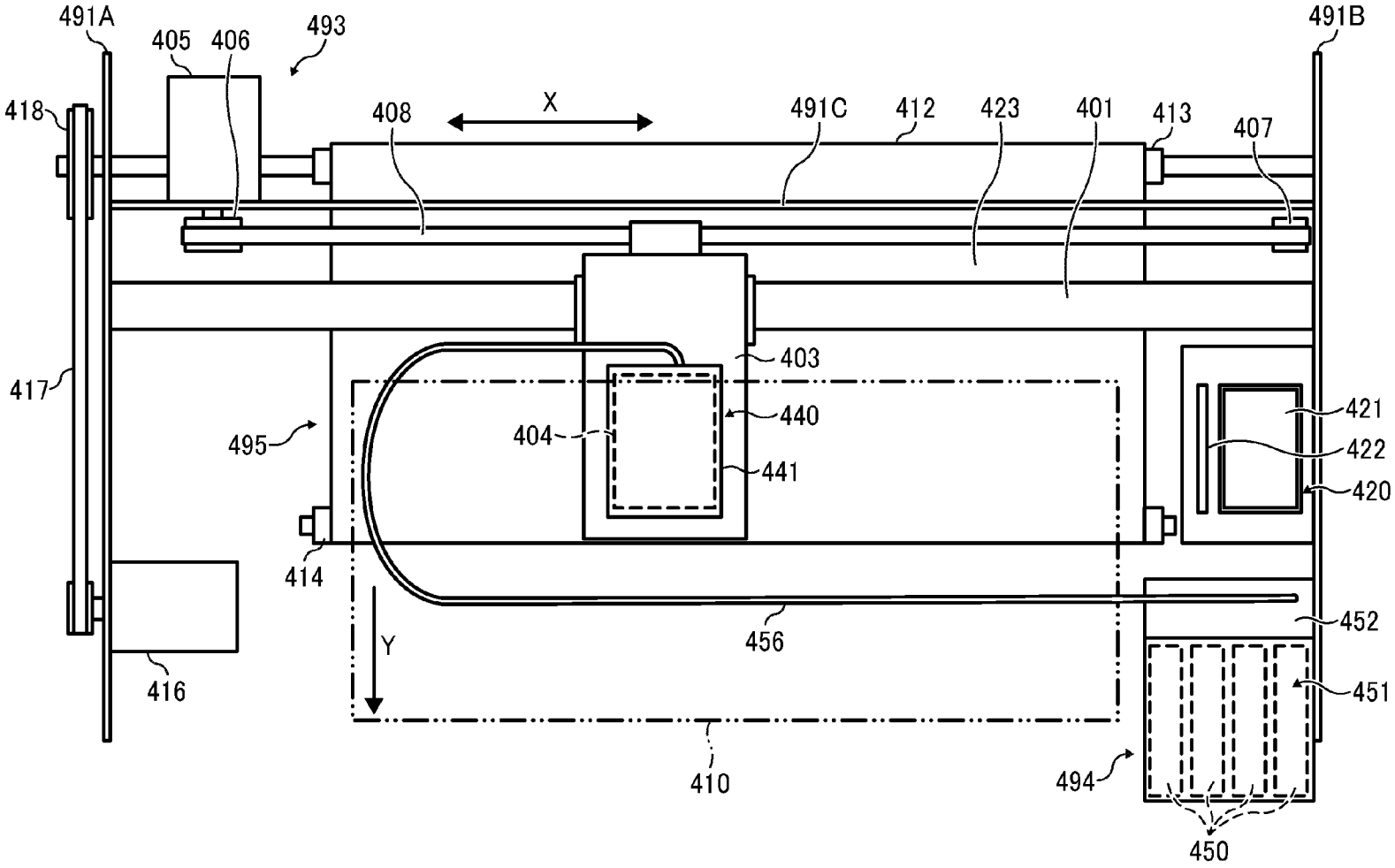
FIG. 1 is a plan explanatory view of main parts of an example of an apparatus for ejecting liquid according an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 2:
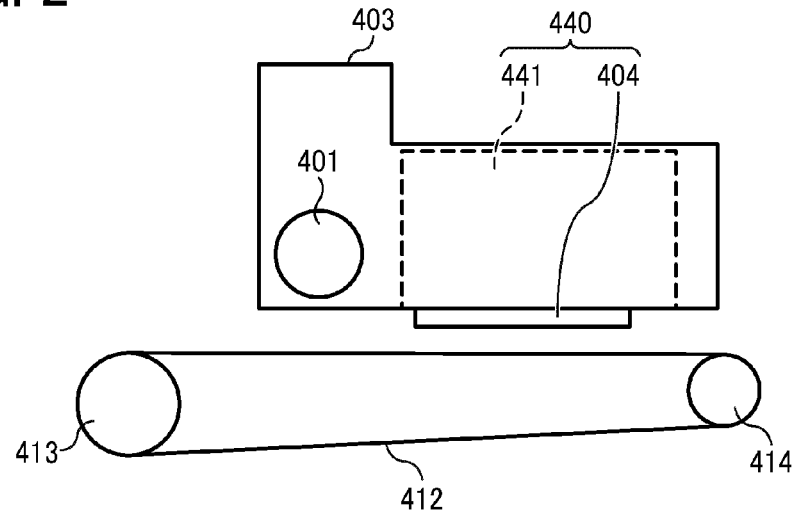
FIG. 2 is a side explanatory view of main parts of the same apparatus according an embodiment of the present invention.

Hereinafter, embodiments of the present invention will be described referring to the accompanying drawings. An example of an apparatus for ejecting liquid according to the present invention will be described referring to FIGS. 1 and 2. FIG. 1 is a plan explanatory view of main parts of the apparatus, and FIG. 2 is a side explanatory view of main parts of the apparatus. In FIG. 1, X represents a main-scanning direction, and Y represents a sub-scanning direction.

This apparatus is a serial type apparatus, and a carriage 403 reciprocates in a main scanning direction by a main scanning movement mechanism 493. The main scanning movement mechanism 493 includes a guide member 401, a main scanning motor 405, a timing belt 408 and the like. The guide member 401 extends between left and right side plates 491A and 491B to movably hold the carriage 403. Further, the carriage 403 reciprocates in the main scanning direction by the main scanning motor 405, via the timing belt 408 that extends between a driving pulley 406 and a driven pulley 407.

The carriage 403 is equipped with a liquid ejection unit 440 in which a liquid ejection head 404 and a head tank 441 are integrated. The liquid ejection head 404 of the liquid ejection unit 440, for example, ejects liquids of each color of yellow (Y), cyan C, magenta (M) and black (K). Also, the liquid ejection head 404 disposes the nozzle row including a plurality of nozzles in a sub-scanning direction orthogonal to the main scanning direction, and mounts the ejection direction downward.

By a supply mechanism 494 that supplies liquid stored outside the liquid ejection head 404 to the liquid ejection head 404, the liquid stored in the liquid cartridge 450 is supplied to the head tank 441.

The supply mechanism 494 includes a cartridge holder 451 as a filler that mounts the liquid cartridge 450, a tube 456, a liquid-feeding unit 452 including a liquid-feeding pump and the like. The liquid cartridge 450 is mounted to the cartridge holder 451 to be attachable and detachable. The liquid is fed to the head tank 441 from the liquid cartridge 450 via the tube 456 by the liquid-feeding unit 452.

The apparatus is equipped with a conveying mechanism 495 that conveys a sheet material 410. The conveying mechanism 495 includes a conveying belt 412 as a conveyer, and a sub-scanning motor 416 that drives the conveying belt 412.

The conveying belt 412 adsorbs the sheet material 410 and conveys the sheet material 410 to a position facing the liquid ejection head 404. The conveying belt 412 is an endless belt and extends between a conveying roller 413 and a tension roller 414. The adsorption can be performed by electrostatic adsorption, air suction or the like.

Further, when the conveying roller 413 is rotationally driven via the timing belt 417 and the timing pulley 418 by the sub-scanning motor 416, the conveying belt 412 circularly moves in the sub-scanning direction.

Furthermore, on one side of the carriage 403 in the main scanning direction, a maintenance and recovery mechanism 420 that performs the maintenance and recovery of the liquid ejection head 404 is disposed on the side of the conveying belt 412.

The maintenance and recovery mechanism 420, for example, includes a cap 421 that caps a nozzle surface (a surface on which nozzles are formed) of the liquid ejection head 404, a wiper member 422 that wipes the nozzle surface and the like.

A main scanning movement mechanism 493, the supply mechanism 494, the maintenance and recovery mechanism 420 and the conveying mechanism 495 are mounted to a housing that includes side plates 491A and 491B, and a back plate 491C.

In the apparatus having such a configuration, the sheet material 410 is fed and adsorbed onto the conveying belt 412, and the sheet material 410 is conveyed in the sub-scanning direction by the circumferential movement of the conveying belt 412.

Therefore, by driving the liquid ejection head 404 in accordance with an image signal, while moving the carriage 403 in the main scanning direction, liquid is ejected to the stopped sheet material 410 to form an image.

Figure 3:
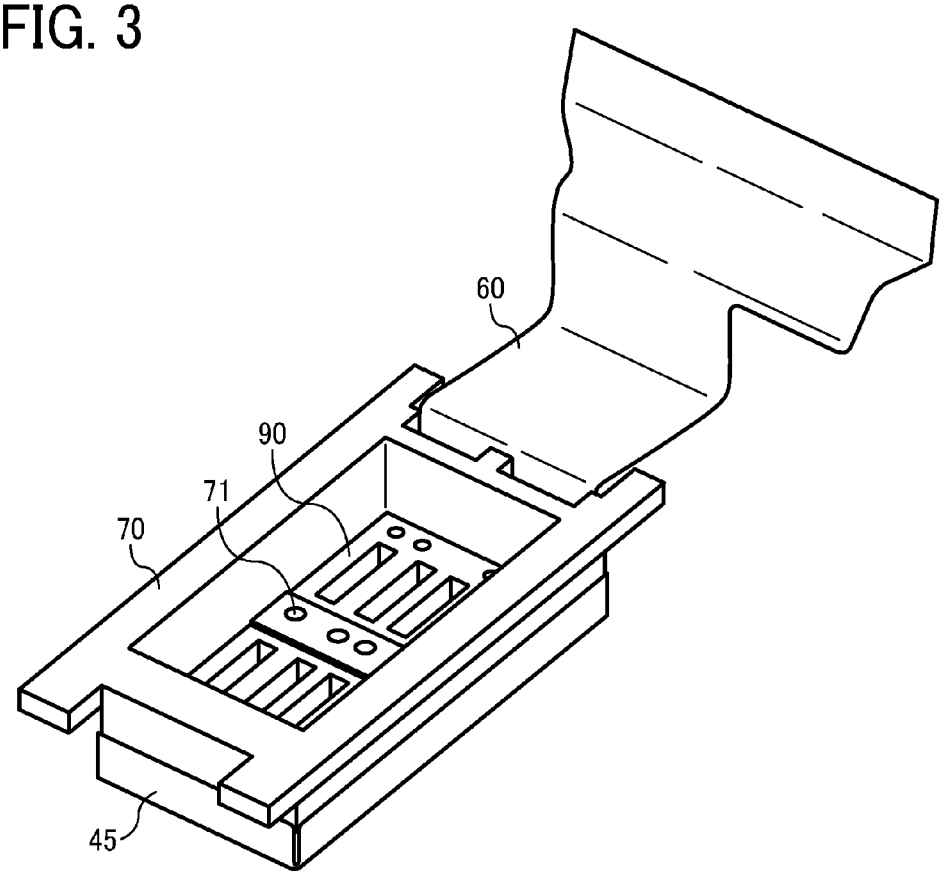
FIG. 3 is an exploded perspective explanatory view of an example of a liquid ejection head according an embodiment of the present invention.
Figure 4:
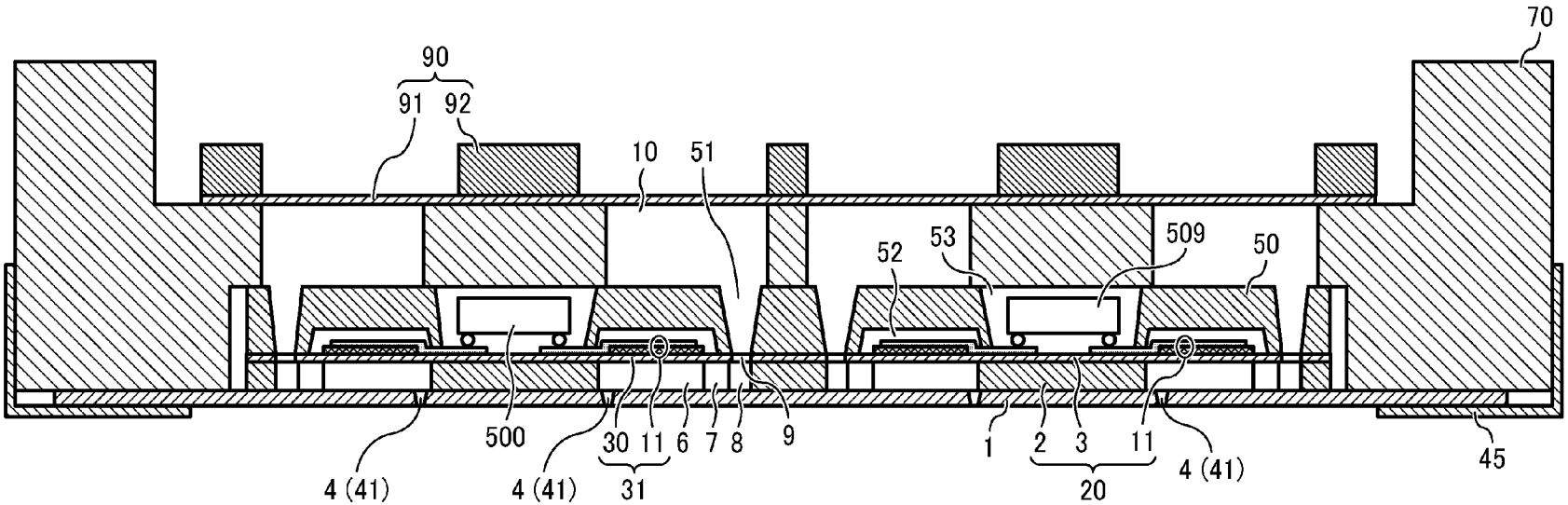
FIG. 4 is a cross-sectional explanatory view taken along a direction orthogonal to a nozzle arrangement direction of the liquid ejection head according an embodiment of the present invention.
Figure 5:
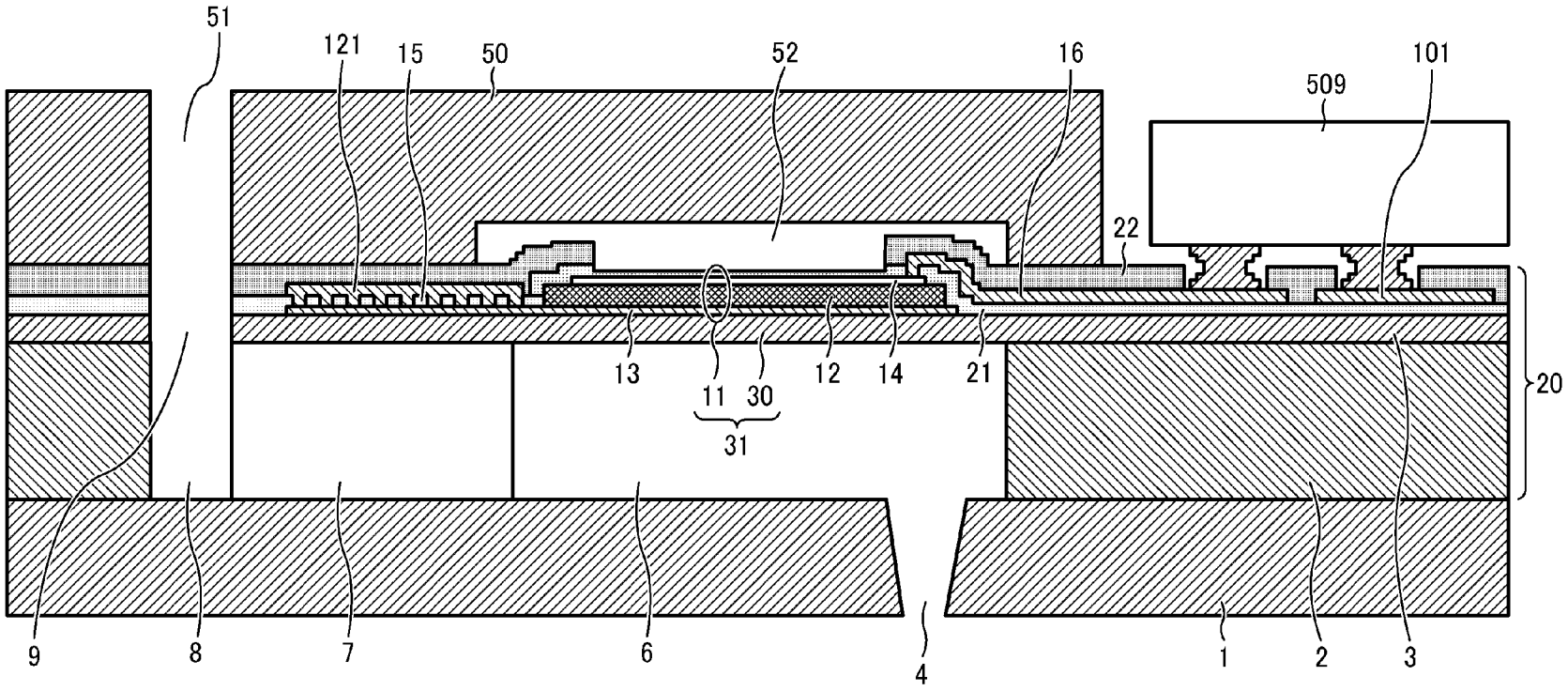
FIG. 5 is an enlarged cross-sectional explanatory view of main parts of FIG. 2 according an embodiment of the present invention.
Figure 6:
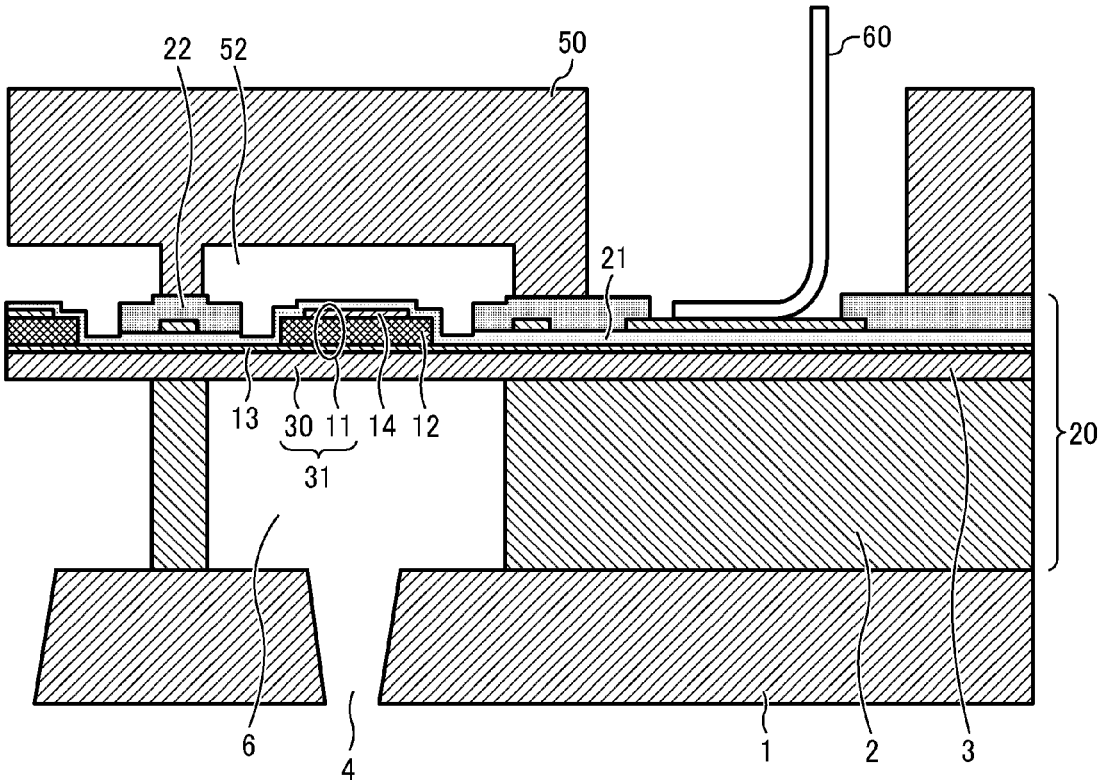
FIG. 6 is a cross-sectional explanatory view of main parts taken along the nozzle arrangement direction of the liquid ejection head according an embodiment of the present invention.

Next, an example of the liquid ejection head will be described referring to FIGS. 3 to 6. FIG. 3 is an exploded perspective explanatory view of the liquid ejection head, FIG. 4 is a cross-sectional explanatory view taken along the direction orthogonal to the nozzle arrangement direction of the liquid ejection head, FIG. 5 is an enlarged cross-sectional explanatory view of main parts of FIG. 2, and FIG. 6 is a cross-sectional explanatory view of main parts along the nozzle arrangement direction of the liquid ejection head.

The liquid ejection head includes a nozzle plate 1, a flow passage plate 2, a vibrating plate 3 as a wall member, a piezoelectric element 11 as a pressure generating element, a holding substrate 50, a wiring member 60, and a frame member 70 that also serves as a common liquid chamber member.

Here, a section including the flow passage plate 2, the vibrating plate 3 and the piezoelectric element 11 is referred to as an actuator substrate 20. However, it does not mean that after the independent member is formed as the actuator substrate 20, the actuator substrate 20 is joined to the nozzle plate 1 or the holding substrate 50.

The nozzle plate 1 is formed with a plurality of nozzles 4 that ejects liquid. Here, nozzle rows 41 having an array of nozzles 4 are disposed in four rows.

The flow passage plate 2, the nozzle plate 1 and the vibrating plate 3 form an individual liquid chamber 6 communicating with the nozzle 4, a fluid resistance member 7 communicating with the individual liquid chamber 6, and a liquid introducer 8 communicating with the fluid resistance member 7.

The liquid introducer 8 communicates with the common liquid chamber 10 that is formed in the frame member 70 via a supply port 9 of the vibrating plate 3 and an opening 51 serving as a flow passage of the holding substrate 50.

The vibrating plate 3 forms a deformable vibration region 30 which forms a part of the wall surface of the individual liquid chamber 6. Further, on the surface of the vibration region 30 of the vibrating plate 3 opposite to the individual liquid chamber 6, the piezoelectric element 11 is provided integrally with the vibration region 30, and a piezoelectric actuator 31 is constituted by the vibration region 30 and the piezoelectric element 11.

The piezoelectric element 11 is constituted by sequentially stacking a common electrode 13 serving as a lower electrode, a piezoelectric layer (piezoelectric body) 12, and an individual electrode 14 serving as an upper electrode from the vibration region 30 side. An insulating film 21 is formed on the piezoelectric element 11.

As illustrated in FIG. 4, the common electrode 13 of the plurality of piezoelectric elements 11 is a single electrode layer formed across the entire piezoelectric elements 11 in the nozzle arrangement direction, and a common electrode power supply wiring pattern 121 is connected to a portion 15 which does not constitute the piezoelectric element 11.

Further, the individual electrode 14 of the piezoelectric element 11 is connected to a drive integrated circuit (IC) (referred to as "head driver" in the circuit arrangement) 509 as a driver circuit via the individual wiring 16. Further, the individual wiring 16 is covered with an insulating film 22.

The drive IC 509 is mounted on the actuator substrate 20 to cover a region between the rows of the piezoelectric element rows by a method such as flip chip bonding.

Further, a holding substrate 50 is provided on the actuator substrate 20.

The holding substrate 50 is also a flow passage forming member that forms a part of the wall surface of the common liquid chamber 10 and forms a part of the flow passage from the common liquid chamber 10 to the individual liquid chamber 6, and forms an opening 51 serving as a flow passage that communicates with the common liquid chamber 10 and the individual liquid chamber 6 side.

The holding substrate 50 also has a function of holding the actuator substrate 20, and is formed with a recess 52 that houses the piezoelectric element 11, and an opening 53 that houses the drive IC 509.

The frame member 70 forms the common liquid chamber 10 that supplies liquid to each of the individual liquid chambers 6. The common liquid chamber 10 is provided to correspond to each of the four nozzle rows. Further, the desired color of the liquid is supplied to the common liquid chamber 10 via the liquid supply port 71 (FIG. 1) from the outside.

A damper member 90 is joined to the frame member 70. The damper member 90 has a deformable damper 91 which forms a partial wall surface of the common liquid chamber 10, and a damper plate 92 that reinforces the damper 91.

The frame member 70 is joined to the outer periphery of the nozzle plate 1, and houses the actuator substrate 20 and the holding substrate 50 to form a frame of the head.

Further, a cover member 45 that covers the periphery of the nozzle plate 1 and a part of the outer peripheral surface of the frame member 70 is provided.

In the liquid ejection head, by applying a voltage between the common electrode 13 and the individual electrode 14 of the piezoelectric element 11 of the piezoelectric actuator 31 from the drive IC 509, the piezoelectric element 11 is subjected to flexural deformation, and by flexure of the vibration region 30 to the individual liquid chamber 6 side to pressurize the internal liquid, the liquid is ejected from the nozzle 4.

Figure 7:
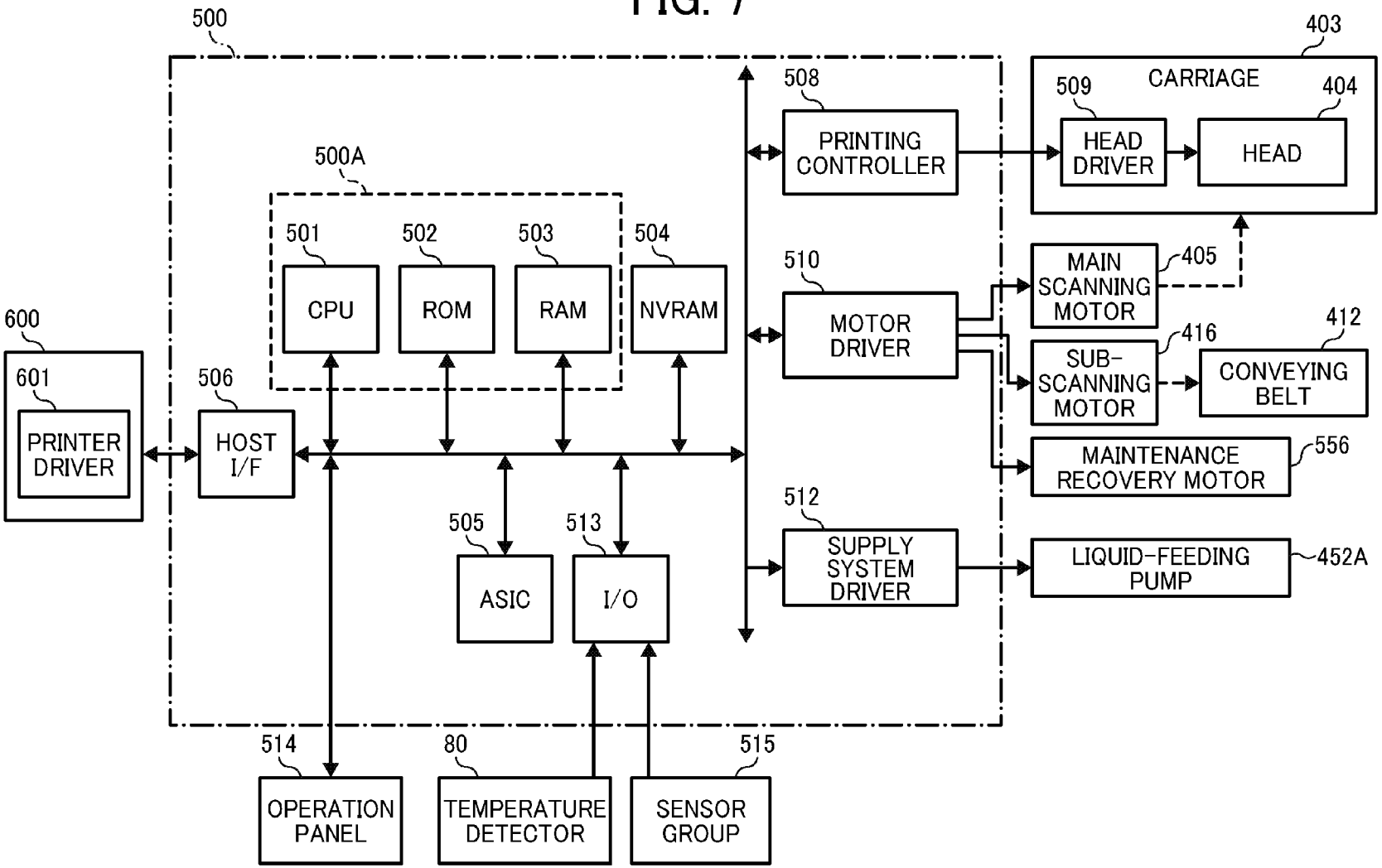
FIG. 7 is a block explanatory view of a controller of the apparatus according an embodiment of the present invention.

Next, a summary of the controller of the apparatus will be described referring to FIG. 7. FIG. 7 is a block explanatory view of the controller.

The controller 500 includes a central processing unit (CPU) 501 that controls the entire apparatus, a read only memory (ROM) 502 that stores secured data such as various programs including a program executed by the CPU 501, and a main controller 500A including a random-access memory (RAM) 503 that temporarily stores image data and the like.

The controller 500 includes a rewritable nonvolatile memory 504 that holds data even while the power of the apparatus is cut off. The controller 500 includes an application-specific integrated circuit (ASIC) 505 that performs various signal processing on the image data, image processing for performing rearrangement or the like, or other input and output signal processing for controlling the entire device.

The controller 500 includes a data transferer that controls driving the liquid ejection head 404, a driving signal generator, a print controller 508 including a bias voltage output, and a drive IC (where, referred to as "head driver") 509 that drives the liquid ejection head 404.

The controller 500 includes a motor driver 510 for driving a maintenance and recovery motor 556 that performs the movement of a main scanning motor 405 for moving and scanning the carriage 403, a sub-scanning motor 416 that circularly moves the conveying belt 412, and the cap 421 and the wiper member 422 of the maintenance and recovery mechanism 420, and driving of a suction member connected to the cap 421.

The controller 500 is provided with a supply system driver 512 that drives the liquid-feeding pump 452A of the liquid-feeding unit 452.

The controller 500 includes an I/O member 513. The I/O member 513 can process various types of sensor information, and obtains the detection signal from a temperature detector 80 of the liquid ejection head 404, and information from various sensor groups 515 mounted on the apparatus. Further, information necessary for control of the apparatus is extracted and used for the control of the print controller 508 or the motor driver 510.

The sensor group 515 includes an optical sensor for detecting the position of the other sheet materials P, an interlock switch and the like for detecting the opening and closing of the cover.

An operation panel 514 for inputting and displaying information necessary for the apparatus is connected to the controller 500.

Here, the controller 500 has an I/F 506 for transmitting or receiving data and signals with the host side, and receives the data and signals from the host 600 side such as an information processing apparatus such as a personal computer and an image reading apparatus, via a cable or a network by the I/F 506.

Further, the CPU 501 of the controller 500 reads and analyzes the print data in the reception buffer included in the I/F 506, performs the image processing and rearrangement processing of data required in the ASIC 505, and transmits the image data from the print controller 508 to the head driver 509. Further, the generation of dot pattern data for outputting an image may be performed by the printer driver 601 of the host 600 side, or may be performed by the controller 500.

The print controller 508 transfers the image data in the serial data, and outputs the transfer clock and the latch signal necessary for the transfer of image data and determination of the transfer, the control signal and the like to the head driver 509.

The print controller 508 includes a driving signal generator including a D/A converter that performs the D/A conversion of the pattern data of the driving waveform, a voltage amplifier, a current amplifier and the like. Further, the print controller 508 generates the driving waveform including a single driving pulse or a plurality of driving pulses, and outputs the driving waveform to the head driver 509.

The head driver 509 selects the driving pulse forming the driving waveform applied from the print controller 508 based on the image data corresponding to one line of the liquid ejection head 404 to be input in serial, and applies the driving pulse to the piezoelectric element 11 as a pressure generator of the liquid ejection head 404. The liquid ejection head 404 is driven accordingly.

At this time, all or a part (a part of the waveform element forming the driving pulse) of one or more driving pulses forming the driving waveform is selected. Thus, for example, it is possible to divide dots having different sizes such as large droplets, medium droplets, and small droplets.

Figure 8:
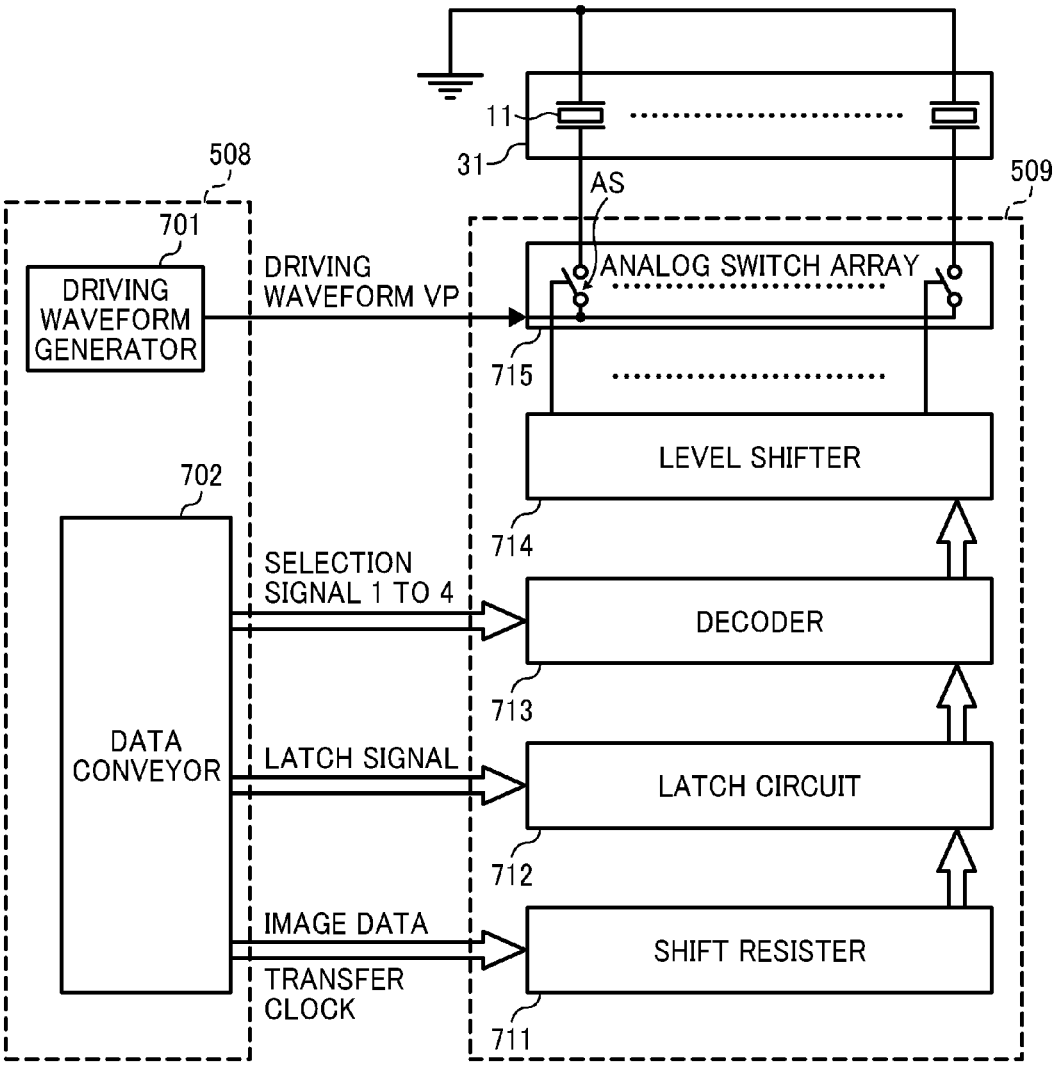
FIG. 8 is a block explanatory view of an example of a part associated with the driving control of the head according an embodiment of the present invention.

Next, an example of a portion relating to drive control of the head will be described below referring to the block explanatory view of FIG. 8.

The print controller 508 includes a driving waveform generator 701 as a driving waveform generator that generates and outputs a driving waveform VP. Further, the print controller 508 includes a data transferer 702 that outputs the image data (gradation signals 0, 1) of 2 bits corresponding to the print image, a clock signal, a latch signal, and a selection signal for selecting the driving pulse constituting the driving waveform.

Here, a driving waveform VP in which a plurality of driving pulses (drive signals) for ejecting the liquid is arranged in time series is generated and output within one printing cycle (one driving cycle) from the driving waveform generator 701.

Further, the selection signal is a signal that instructs opening and closing of the analog switch AS as a switch of the head driver 509 for each droplet. State transition of the driving pulse (or with waveform element) to be selected in accordance with the print cycle of the driving waveform VP to a H level (ON) is performed, and the state transition of the driving pulse to a L level (OFF) is performed at the time of the non-selection.

The head driver 509 includes a shift register 711, a latch circuit 712, a decoder 713, a level shifter 714 and an analog switch array 715.

The shift register 711 inputs the transfer clock (shift clock) from the data transferer 702 and serial image data (gradation data: 2-bit/1-channel (1 nozzle)). The latch circuit 712 latches each resist value of the shift register 711 by the latch signal.

The decoder 713 decodes the gradation data and the selection signal, and outputs the result. The level shifter 714 performs a level conversion of a logic level voltage signal of the decoder 713 to a level in which the analog switch AS of the analog switch array 715 can operate.

The analog switch AS of the analog switch array 715 is turned on/off (open and closed) by the output of the decoder 713 that is given via the level shifter 714.

The analog switch AS of the analog switch array 715 is connected to the individual electrode 14 of the piezoelectric element 11, and the driving waveform VP from the driving waveform generator 701 is input. Therefore, the analog switch AS is turned on in accordance with the result obtained by decoding the image data (gradation data) and the selection signals transferred in serial by the decoder 713. Accordingly, the required driving pulses (or waveform element) constituting the driving waveform VP are passed (selected), and are applied to the individual electrodes 14 of the piezoelectric element 11.

Figure 9:
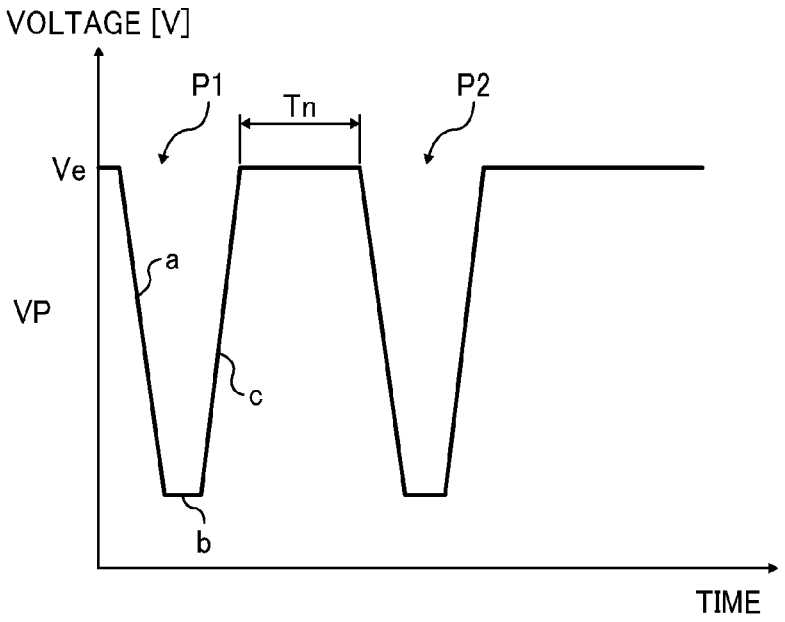
FIG. 9 is an explanatory view of a driving pulse of a driving waveform according to a first embodiment of the present invention.

The first embodiment of the present invention will be described below referring to FIG. 9. FIG. 9 is an explanatory view illustrating a driving pulse of the driving waveform in the embodiment.

In the present embodiment, the driving waveform VP includes two continuous driving pulses P1 and P2 that eject liquid. Droplets ejected by the driving pulse P1 and P2 are merged with each other to form a single droplet during flight.

Both of the driving pulses P1 and P2 include a pull-in waveform element (also referred to as an expansion waveform element) 'a', a holding waveform element 'b', and a push-in waveform element (also referred to as a contraction waveform element) 'c'. Further, symbols of 'a' to 'c' illustrate only the driving pulse P1 to simplify the drawings.

The pull-in waveform element 'a' is a waveform element which falls from the reference potential (intermediate potential) Ve to expand the individual liquid chamber 6. The holding waveform element 'b' is a waveform element that holds the falling potential of the pull-in waveform element 'a'. The push-in waveform element 'c' is a waveform element that rises from the potential held by the holding waveform element 'b' and contracts the individual liquid chambers 6 to eject the liquid.

Further, in the continuous two driving pulses, the time from the end of the push-in waveform element 'c' of the preceding driving pulse to the start of the pull-in waveform element 'a' of the succeeding driving pulse is set as a "pulse interval".

Here, in the present embodiment, when a natural vibration period (an inverse number of the resonant frequency) of the individual liquid chamber 6 is set as Tc, and the time from a first peak of pressure fluctuation in the individual liquid chamber 6 caused by the preceding driving pulse P1 to a first peak of residual pressure fluctuation in the individual liquid chamber 6 due to pressure fluctuation in the common liquid chamber 10 caused by the pressure fluctuation in the individual liquid chamber 6 is set as x0, a pulse interval Tn between the driving pulse P1 and the driving pulse P2 is set as $Tn=n\times Tc/2+x0$ (where, n is a natural number).

Thus, it is possible to reduce variations in ejection velocity between the nozzles caused by the pressure fluctuation in the common liquid chamber 10. The "variation in the ejection speeds between the nozzles" is a variation in the ejection velocity caused by difference in positions of each nozzle arranged in the nozzle arrangement direction (the longitudinal direction of the common liquid chamber).

Figure 10:
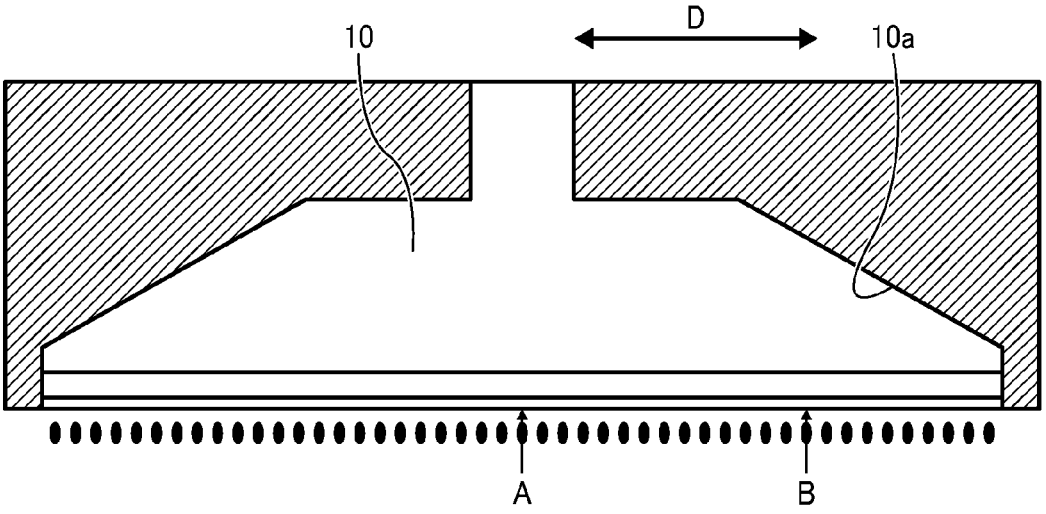
FIG. 10 is a cross-sectional explanatory view of a common liquid chamber along the nozzle arrangement direction according an embodiment of the present invention.
Figure 11:
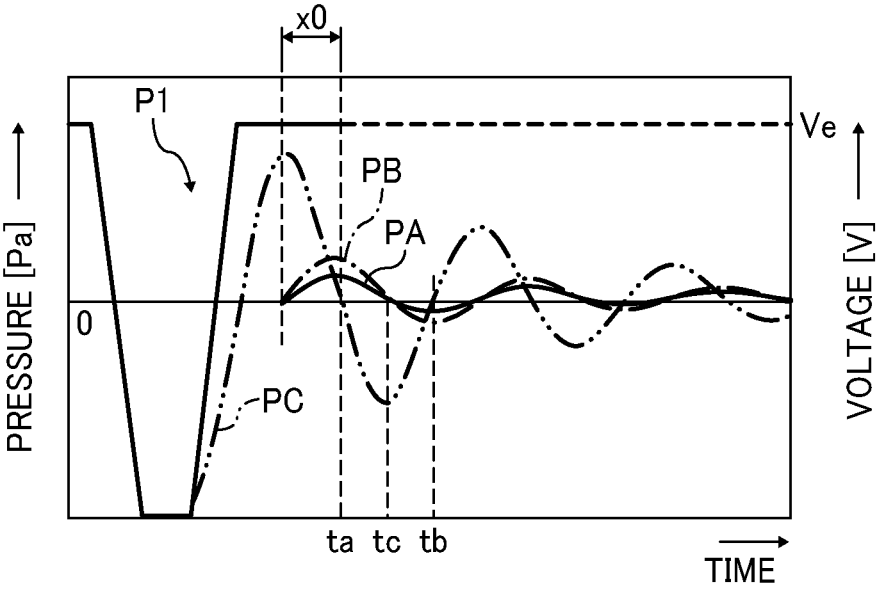
FIG. 11 is an explanatory view illustrating a relation between a voltage change in the driving waveform and a pressure fluctuation in the individual liquid chamber according an embodiment of the present invention.
Figure 12A:
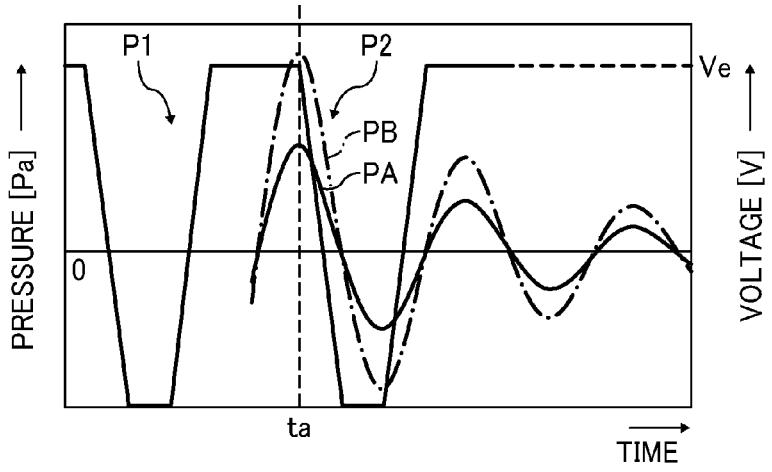
FIGS. 12A to 12C are explanatory views illustrating pulse intervals of two continuous driving pulses according an embodiment of the present invention.
Figure 12B:
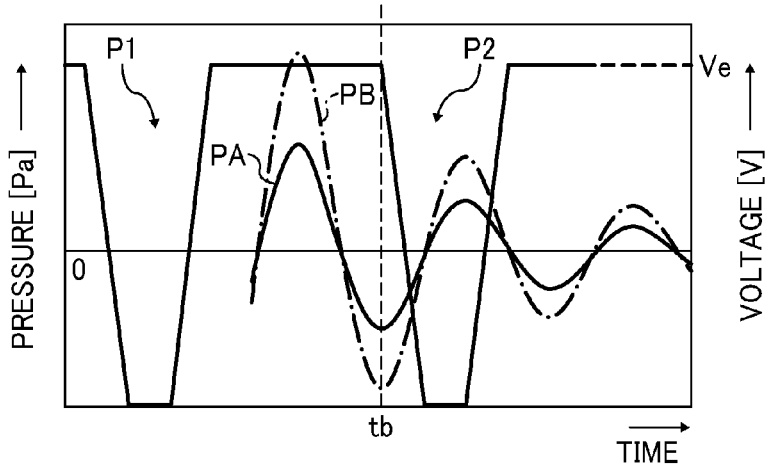
Figure 12C:
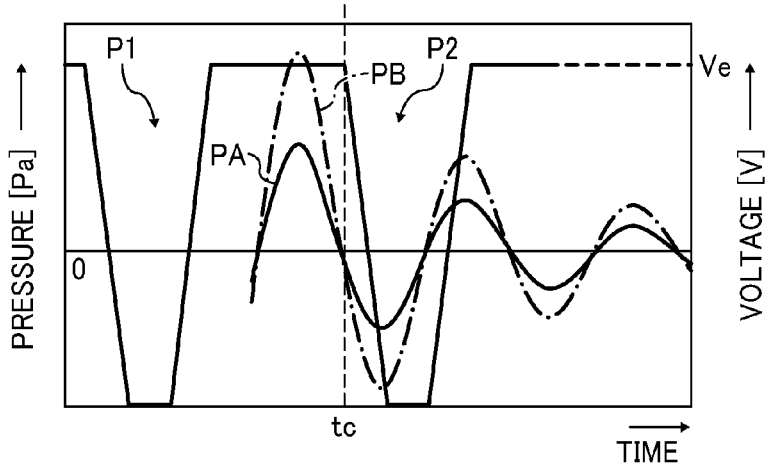
Figure 13A:
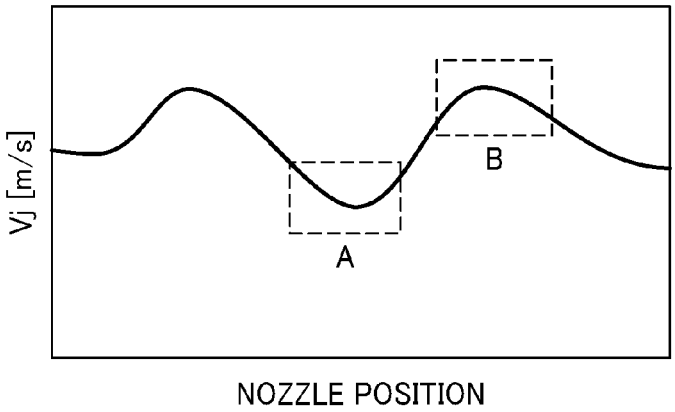
FIGS. 13A to 13C are explanatory views illustrating the ejection velocity at each nozzle position according an embodiment of the present invention.
Figure 13B:
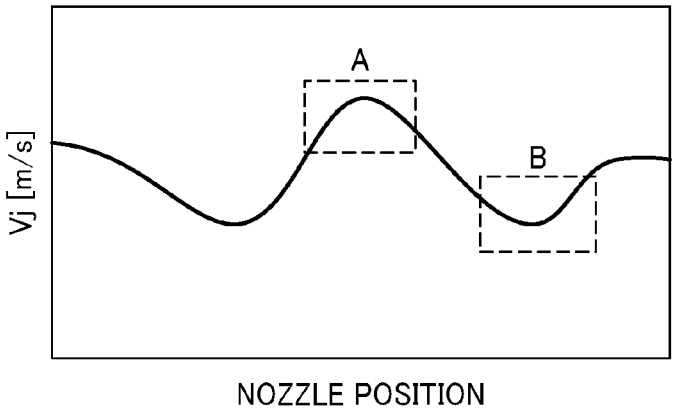
Figure 13C:
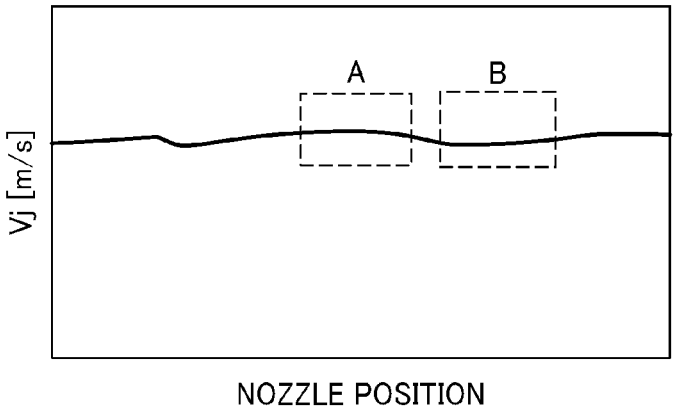

This will be described referring to FIGS. 10 to 13. FIG. 10 is a cross-sectional explanatory view of a common liquid chamber along the nozzle arrangement direction D, and FIG. 11 is an explanatory view illustrating a relation between a voltage change in driving waveform and a pressure fluctuation in the individual liquid chamber. FIGS. 12A to 12C are explanatory views illustrating the pulse intervals between the two continuous driving pulses, and FIGS. 13A to 13C are explanatory views illustrating the ejection velocity at each nozzle position. Further, FIGS. 12A to 12C illustrate only the pressure fluctuations PA and PB of FIG. 11, and the magnitude of the pressure is different between FIGS. 12A to 12C and 11.

As illustrated in FIG. 10, inclined surfaces 10*a* are provided at both ends of the common liquid chamber 10 in the nozzle arrangement direction D, and the common liquid chamber 10 has a shape that narrows toward the end. Here, in the nozzle arrangement direction D, a central portion (portion that does not narrow) is set a position (region) A, and an end (portion which narrows) is set as a position (region) B.

As illustrated in FIG. 11, a single driving pulse P1 is applied to a pressure generator (in this case, the piezoelectric element 11) corresponding to the entire nozzles 4 to eject the liquid (droplets).

At this time, residual pressure fluctuation (hereinafter, simply referred to as a "pressure fluctuations") PA occurs in the individual liquid chamber 6 corresponding to the position A of the common liquid chamber 10, and the same pressure fluctuation PB occurs in the individual liquid chamber 6 corresponding to the position B of the common liquid chamber 10. That is, the pressure fluctuations caused by pressurization of the individual liquid chamber 6 applied by the driving pulse P1 is propagated into the common liquid chamber 10, and the residual pressure fluctuations PA and PB occur in the individual liquid chamber 6 due to pressure fluctuation in the common liquid chamber 10.

In this case, although the amplitude in the time change of the pressure in the individual liquid chamber 6 varies depending on the shape, material or the like of the common liquid chamber 10, in the case of the common liquid chamber shape having a constriction as illustrated in FIG. 10, the amplitude of the pressure fluctuation PB at the end becomes greater than the pressure fluctuations PA in the center of the nozzle row (PA<PB). Thus, the distribution of the amplitudes is generated in the pressure fluctuation generated in the common liquid chamber 10 (this is called "pressure distribution in the common liquid chamber"), which is reflected as a pressure fluctuation in the individual liquid chamber 6.

Further, the timing when the pressure fluctuations PA and PB are 0 is set as a time 'tc', the timing when the pressure fluctuations PA and PB are the maximum value (first peak) before the time 'tc' is set as a time 'ta', and the timing when the pressure fluctuations PA and PB become a minimum value after the time 'tc' is set as a time 'tb'.

Here, as illustrated in FIGS. 12A to 12C, when the driving pulse P2 is consecutively applied to the driving pulse P1, depending on whether the timing of applying the driving pulse P2 (the start of the pull-in waveform element) is one of the times ta, tb and tc, as illustrated in FIGS. 13A to 13C, variations occur in the distribution of the ejection velocity (drop velocity Vj) after the droplets ejected by the driving pulse P1 and the droplets ejected by the driving pulse P2 are merged with each other.

That is, normally, as long as the pressure is high at the time of pull-in start of the pull-in waveform element 'a' of the second driving pulse P2, a pull-in amount after the application of the second driving pulse P2 increases, and the drop velocity of the droplets ejected at the second driving pulse P2 becomes faster.

Meanwhile, as long as the pressure is low at the time of pull-in start of the pull-in waveform element 'a' of the second driving pulse P2, the pull-in amount after the application of the second driving pulse P2 decreases, and the drop velocity of the droplets ejected at the second driving pulse P2 becomes slower.

Therefore, as illustrated in FIG. 12A, when giving the driving pulse P2 at time 'ta', since the pressure at the time of pull-in start is higher in the region B than the region A, the drop velocity of the droplets ejected at the driving pulse P2 becomes faster in the region B.

Thus, the drop velocity Vj after merging the two droplets becomes a relation of B>A in the regions B and A, and the distribution of the drop velocity Vj when performing the driving for simultaneously ejecting the liquid from a plurality of nozzles is as illustrated in FIG. 13A.

Similarly, as illustrated in FIG. 12B, when giving the driving pulse P2 at the time tb, since the pressure at the time of pull-in start is higher in the region A than the region B, the drop velocity of the droplets ejected at the driving pulse P2 becomes faster in the region A.

Thus, the drop velocity Vj after merging the two droplets becomes a relation of A>B in the regions A and B, and the distribution of the drop velocity Vj when performing the driving for ejecting the liquid from a plurality of nozzles is as illustrated in FIG. 13B.

Similarly, as illustrated in FIG. 12C, when giving the driving pulse P2 at the time tc, since the pressure at the time of pull-in start of the regions A and B is approximately the same (including the same case, hereinafter, the same), the drop velocity of droplets ejected at the driving pulse P2 in the regions A and B becomes substantially the same.

Thus, the drop velocity Vj after merging the two liquid droplets becomes substantially the same relation in the regions A and B, and the distribution of the drop velocity Vj when performing the driving for ejecting the liquid from a plurality of nozzles is as illustrated in FIG. 13C.

In this way, by setting a pulse interval of the driving pulses P1 and P2 at the timing when the pressure difference (a pressure difference between the center and the end in the nozzle arrangement direction) between the pressure fluctuations PA and PB of the individual liquid chamber 6 caused by the pressure fluctuation in the common liquid chamber 10 becomes smaller, as at the time tc, it is possible to suppress variations in ejection velocity between the nozzles in the nozzle arrangement direction.

Here, as illustrated in FIG. 11, when the individual liquid chamber 6 is pressurized by pushing of the push-in waveform element 'c' of the preceding driving pulse P1, a predetermined time lag occurs from the start of the pressure fluctuation PC in the individual liquid chamber 6 to the start of the pressure fluctuation in the individual liquid chamber 6 caused by the pressure fluctuation in the common liquid chamber 10 caused by the pressure fluctuation.

Therefore, in the present embodiment, the time from the first peak of the pressure fluctuation PC in the individual liquid chamber 6 caused by the preceding driving pulse P1 to the first peak of the residual pressure fluctuations PA and PB in the individual liquid chamber 6 caused by the pressure fluctuation in the common liquid chamber 10 caused by the pressure fluctuation in the individual liquid chamber 6 is set as x0.

Accordingly, the pulse interval Tn of the aforementioned time 'c' is obtained by adding the time x0 to (n×Tc/2) as described above.

Thus, by setting the pulse interval Tn as Tn=n×Tc/2+x0 (where, n is a natural number), it is possible to reduce variations in ejection velocity between the nozzles.

Figure 14:
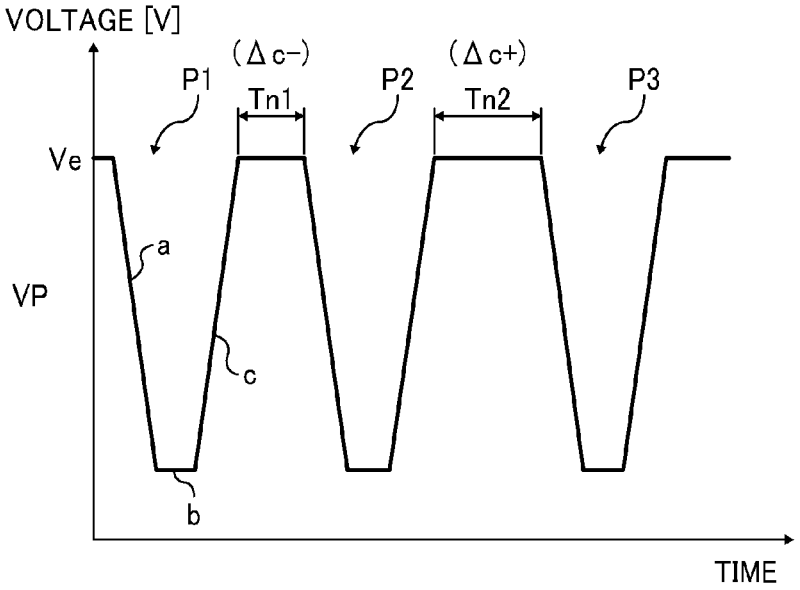
FIG. 14 is an explanatory view of a driving waveform according to a second embodiment of the present invention.

Next, a second embodiment of the present invention will be described referring to FIG. 14. FIG. 14 is an explanatory view illustrating a driving waveform in the embodiment.

In the present embodiment, the driving waveform VP includes three continuous driving pulses P1 to P3 that eject liquid. Droplets ejected by selecting at least two of the driving pulses P1, P2 and P3 are merged into a single droplet during flight.

Here, the pulse interval between the driving pulse P1 and the driving pulse P2 is set as Tn1, and the pulse interval between the driving pulse P2 and the driving pulse P3 is set as Tn2.

Further, a natural vibration period (an inverse of the resonant frequency) of the individual liquid chamber 6 is set as Tc, the time from the first peak of the pressure fluctuation in the individual liquid chamber 6 caused by the preceding driving pulse to the time of the first peak of the residual pressure fluctuation in the individual liquid chamber 6 caused by the pressure fluctuation in the common liquid chamber 10 caused by the pressure fluctuation in the individual liquid chamber 6 is set as x0, and the time obtained by Tn=N×Tc/2+x0 (where, N is an integer) is set as a pulse interval Tn.

At this time, one of the two pulse intervals Tn1 and Tn2 (where, Tn1) is shorter than the pulse interval Tn, and the other (where, Tn2) thereof is longer than the pulse interval Tn.

Figure 15:
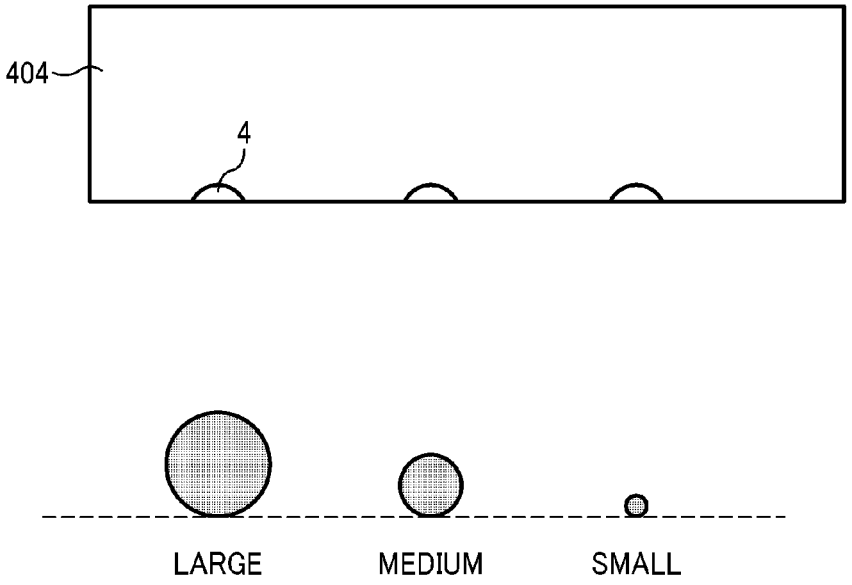
FIG. 15 is an explanatory view illustrating the ejection of droplets of different droplet sizes according an embodiment of the present invention.
Figure 16:
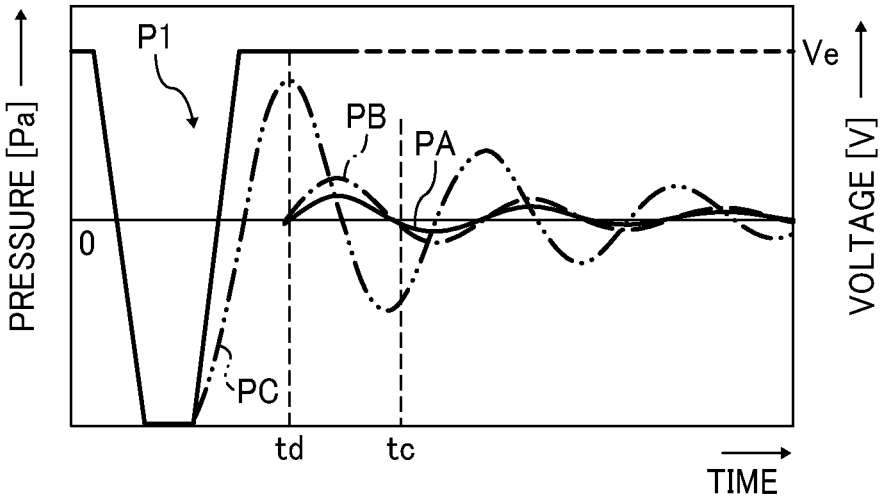
FIG. 16 is an explanatory view illustrating a relation between the voltage change in the driving waveform and the pressure fluctuation in the individual liquid chamber according an embodiment of the present invention.
Figure 17A:
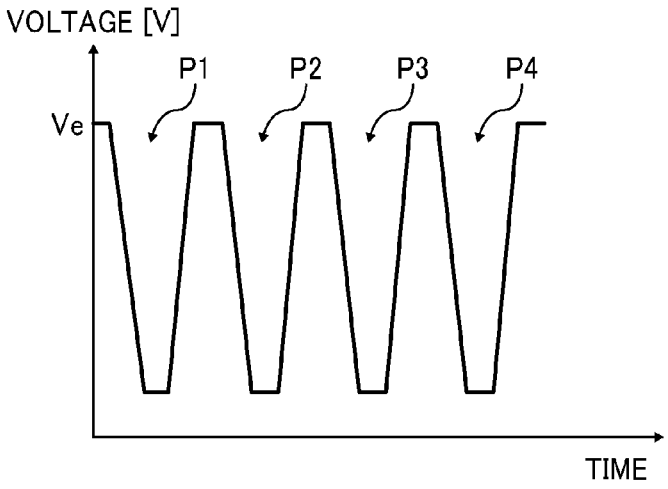
FIGS. 17A to 17C are explanatory views illustrating examples of the ejection driving waveform in the case of ejecting droplets of different droplet sizes using four continuous driving pulses according an embodiment of the present invention.
Figure 17B:
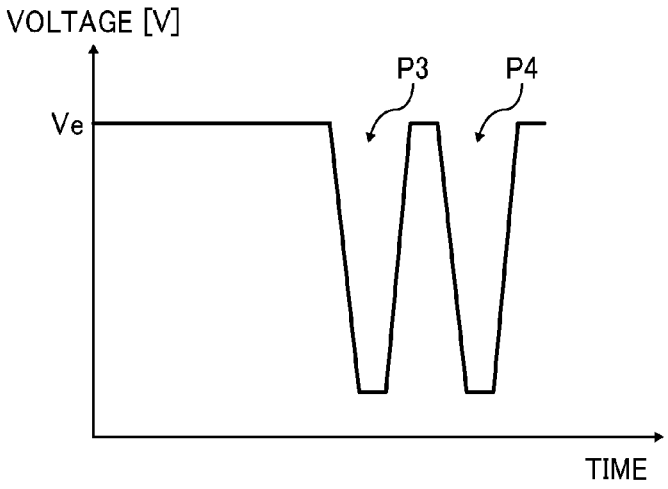
Figure 17C:
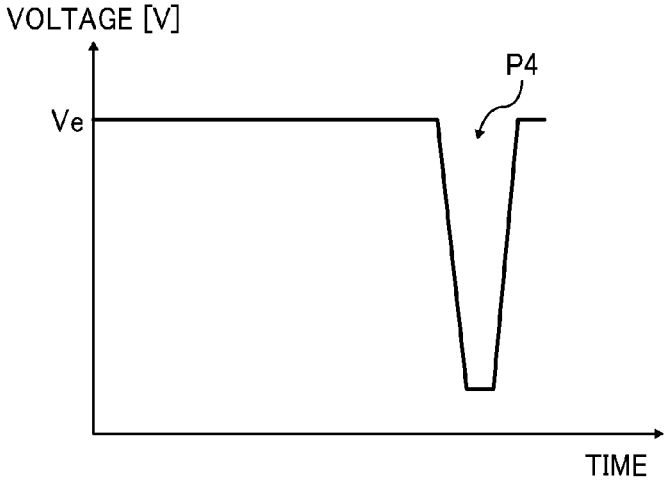
Figure 18:
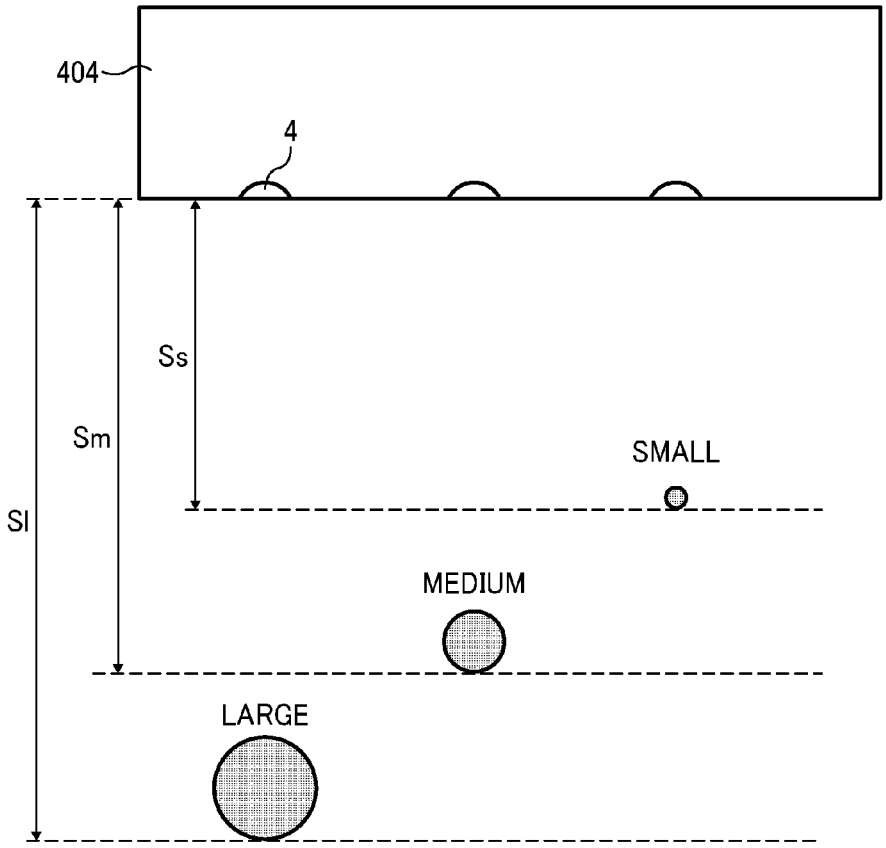
FIG. 18 is an explanatory view illustrating a case where the ejection velocity of the succeeding drop becomes faster according an embodiment of the present invention.
Figure 19:
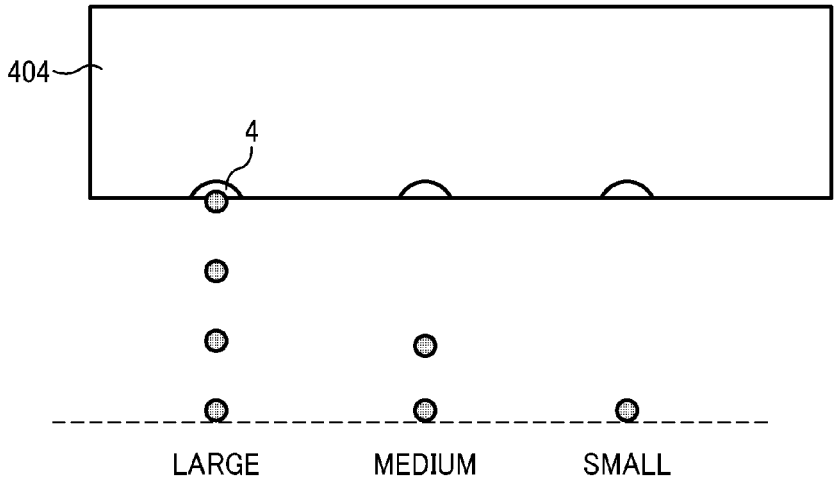
FIG. 19 is an explanatory view illustrating a case where the ejection velocity of the succeeding drop becomes slower according an embodiment of the present invention.
Figure 20:
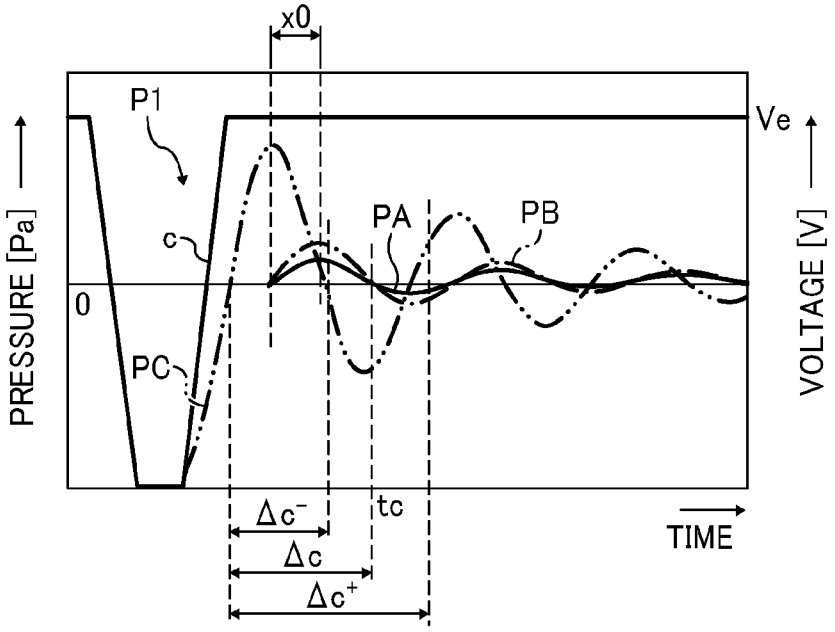
FIG. 20 is an explanatory view illustrating the setting of the pulse interval according an embodiment of the present invention.
Figure 21:
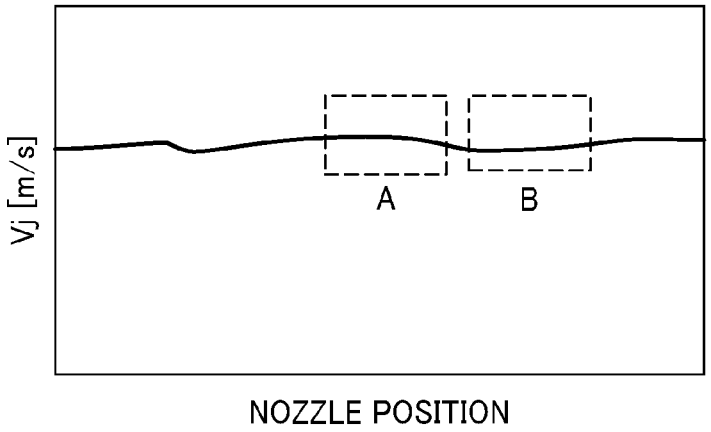
FIG. 21 is an explanatory view illustrating the operation and effect according to the embodiment of the present invention.

This will be described referring to FIGS. 15 to 21. FIG. 15 is an explanatory view illustrating the ejection of droplets of different drop sizes, and FIG. 16 is an explanatory view illustrating a relation between a voltage change in driving waveform and a pressure fluctuation in the individual liquid chamber. FIGS. 17A to 17C are explanatory views illustrating examples of the ejection driving waveform in the case of ejecting droplets of different drop sizes using four continuous drive pulses. FIG. 18 is an explanatory view illustrating a case where the ejection velocity of the succeeding droplet becomes faster. FIG. 19 is an explanatory view illustrating a case where the ejection velocity of the succeeding droplet becomes slower. FIG. 20 is an explanatory view illustrating the setting of the pulse interval, and FIG. 21 is an explanatory view illustrating the operation and effect of this embodiment.

As described in the first embodiment, to reduce variations in ejection velocity of each nozzle in the nozzle arrangement direction, a plurality of driving pulses may be continued at a pulse interval of the timing illustrated in FIG. 12C.

That is, when the driving pulse used from the same driving waveform is cut out (selected) to obtain a plurality of droplets of different sizes, for example, large droplets, medium droplets and small droplets, as illustrated in FIG.

15, there is a need to have the same landing timing (landing timing after the merging) of the large droplets, middle droplets and small droplets.

To align the landing timing, typically, the voltage of each driving pulse is varied, or the pulse interval between the driving pulse and the driving pulse is varied. In this case, in particular, the pulse interval between the driving pulse and the driving pulse is dominant.

However, for example, as illustrated in FIG. 16, when the timing at which the pressure difference in the pressure fluctuations PA and PB caused by the pressure distribution of the common liquid chamber 10 decreases substantially matches the peak of the pressure fluctuation PC caused by the residual vibration of the individual liquid chamber 6 (in the case of deviation of ¼×Tc), it is difficult to align the landing time difference between the droplet sizes.

For example, in the case of the time td of FIG. 16, there is no pressure difference between the pressure fluctuations PA and PB generated by the pressure distribution of the common liquid chamber 10, but the pressure fluctuation PC (residual pressure caused by the ejection) from the individual liquid chamber 6 reaches a peak.

That is, when connecting the plurality of driving pulses at a pulse interval where the pull-in waveform element of the succeeding driving pulse starts at the time td of FIG. 16, as the number of the continuous driving pulses increases, the drop velocity of droplets ejected in the succeeding driving pulse becomes faster.

For example, as illustrated in FIGS. 17A to 17C, the four driving pulses P1 to P4 are connected by ¼×Tc, and as illustrated in FIGS. 17A, 17B and 17C, the driving pulse is selected to form the large droplet, the medium droplet and the small droplet. At this time, as indicated by flight distances Ss, Sm and Sl at the same time of the droplets of each droplet size in FIG. 18, the flight distance changes depending on the droplet size of the droplets after merging, and the landing time difference occurs.

Further, to align the landing time as described above, timing (pulse interval) between the driving pulse and the driving pulse is dominant, and adjustment only using the voltage of the pulse is difficult.

In the case of time tc illustrated in FIG. 16, the residual pressure in the individual liquid chamber 6 becomes the maximum on the negative side. Therefore, if the plurality of driving pulses is connected at the pulse interval in which the pull-in waveform element of the succeeding driving pulse is started at the time tc, as the number of the continuous driving pulses increases, the drop velocity of the succeeding drop becomes slower. As a result, there are risks of a difference in landing time and a failure of merge during flight as illustrated in FIG. 19.

Therefore, in this embodiment, the liquid is ejected at the timing before and after interposing the time tc when the pressure difference in the pressure fluctuations PA and PB caused by the pressure distribution of the common liquid chamber 10 is eliminated.

In other words, the pressure difference in the pressure fluctuations PA and PB caused by the pressure distribution of the common liquid chamber 10 at the elapsed time Δc from the end of the push-in waveform element 'c' of the driving pulse is eliminated referring to FIG. 20.

The elapsed time Δc is time (pulse interval) obtained by the aforementioned "N×Tc/2+x0 (where, N is an integer)".

At this time, as illustrated in FIG. 14, for example, the pulse interval Tn1 between the driving pulse P1 and the driving pulse P2 is set as time Δc− that is shorter than the time Δc. Meanwhile, the pulse interval Tn2 between the driving pulse P2 and the driving pulse P3 is set as time Δc+ that is longer than the time Δc.

In this way, when the pressure difference in the pressure fluctuations PA and PB caused by the pressure distribution of the common liquid chamber 10 at the elapsed time Δc from the end of the push-in waveform element 'c' of the driving pulse is eliminated, as the pulse interval, the pulse interval of the time Δc− shorter than the time Δc and the pulse interval of the time Δc+longer than the time Δc are mixed with each other.

Thus, when the liquid is ejected at the timing of the time Δc− by the second driving pulse P2, since the pressure of the region B side increases at the time of pull-in start (at the start of expansion), the drop velocity becomes B>A. Meanwhile, since the liquid is ejected at the timing of time Δc+ to the second driving pulse P2 by the third driving pulse P3, the pressure of the region A side increases at the time of pull-in start (at the start of expansion), and thus, the drop velocity becomes A>B.

Thus, during flight, when three droplets are merged, increase and decrease of each drop velocity are cancelled. As a result, as illustrated in FIG. 21, variation in the drop velocity Vj for each nozzle position in the nozzle arrangement direction decreases.

Moreover, when the liquid is ejected at the time interval Δc, as described above, since the residual pressure of the individual liquid chamber 6 is the maximum on the negative side at the time of pull-in start (at the start of expansion) of each driving pulse, as the continuous driving pulse increases, the drop velocity becomes slower.

In contrast, when ejecting the liquid at the interval of time Δc−, the residual pressure of the individual liquid chamber 6 becomes slightly negative, and meanwhile, when ejecting the liquids at the interval of time Δc+, the pulling-in (expansion) of the succeeding driving pulse is started at a positive pressure. Therefore, as a result, unlike the case of ejecting the droplets at the interval of time Δc, all droplets are merged.

In this way, in the present embodiment, variations in ejection velocity between the nozzles decreases, and it is also possible to reliably merge the three or more droplets.

Figure 22:
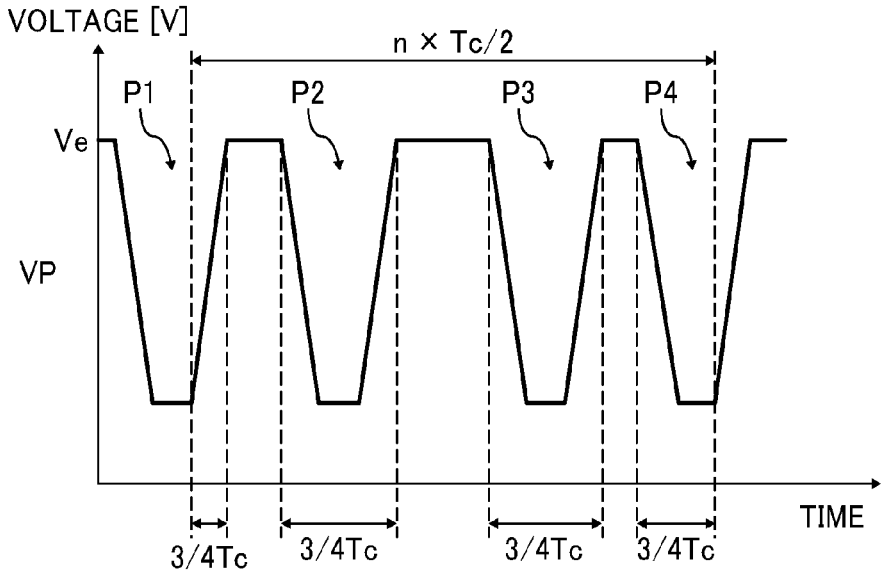
FIG. 22 is an explanatory view of a driving waveform according to a third embodiment of the present invention.

Next, a third embodiment of the present invention will be described referring to FIG. 22. FIG. 22 is an explanatory view illustrating a driving waveform in the embodiment.

In the present embodiment, the driving waveform VP includes four continuous driving pulses P1 to P4 that eject the liquid. Droplets ejected by selecting at least two of the driving pulses P1, P2, P3 and P4 are merged into a single droplet during flight.

Here, both the driving pulses P2 and P3 set the time from the start of the pull-in waveform element 'a' to the end of the push-in waveform element 'c' as ¾ Tc. Further, when the time from the start of the push-in waveform element 'c' of the leading driving pulse P1 to the start of push-in waveform element 'c' of the last driving pulse P4 is set as Ttot, Ttot=n×(Tc/2) (where, n is a natural number).

By setting the time Ttot as described above, even when the pulse interval one before the last driving pulse from the second driving pulse is set at any time, it is possible to reduce the variation in drop velocity Vj between the nozzles.

That is, the pulse interval at which the variation in drop velocity Vj between the nozzles becomes the smallest is the time which is obtained by Tn=n×Tc/2+x0 as described above. At this time, when the number of the plurality of continuous connected driving pulses is set as p, the total time of the pulse interval is (p−1)×(n×Tc/2+x0). Further, the total time of each driving pulse at the time Ttot is (p−1)×¾Tc.

Therefore, the time Ttot at which the variation in drop velocity Vj between the nozzles becomes the smallest is calculated as follows.

$$Ttot = (p-1)\times(n\times Tc/2 + x0) + (p-1)\times 3/4Tc = (p-1)(n\times Tc/2 + x0 + 3/4Tc)$$
$$= Tc/2\times(p-1)(n + 2\times x0 + 3/2)$$
$$= Tc/2\times(p-1)(n + 2\times 1/4 + 3/2)(\because x0:\ 1/4Tc)$$
$$= Tc/2\times(p-1)(n+2)$$

When this is generalized, Ttot=n×(Tc/2): a (n is a natural number).

As discussed in the aforementioned second embodiment, the pressure difference between the pressure fluctuations caused by the pressure distribution in the common liquid chamber 10 can be summed.

Therefore, if the waveform length from the leading driving pulse to the last driving pulse is secured in advance, and the shape of each driving pulse is determined, even when the driving pulses are connected in any interval at that time, as long as Ttot=n×(Tc/2) (n is a natural number) is satisfied, the effect of the pressure interference is consequentially canceled.

Figure 23:
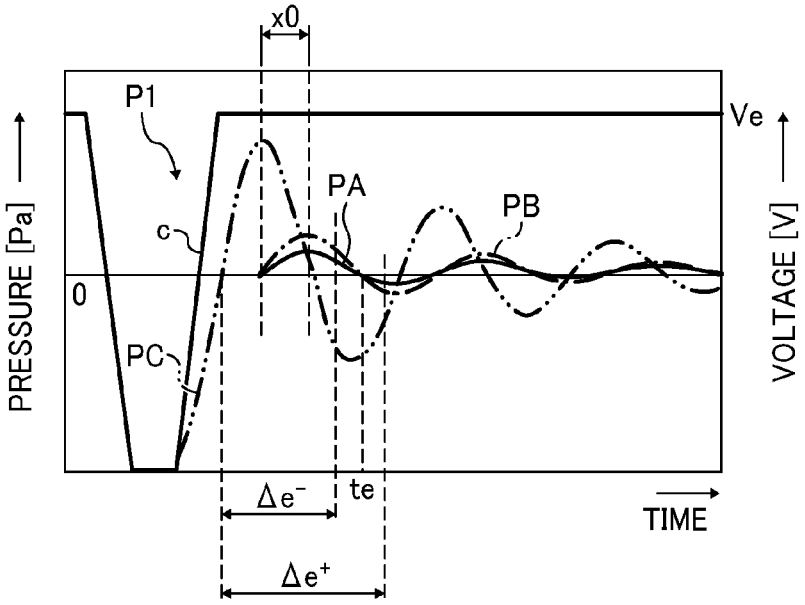
FIG. 23 is an explanatory view illustrating a relation between the voltage change in the driving waveform and the pressure fluctuation in the individual liquid chamber according an embodiment of the present invention.

This will be described referring to FIGS. 23 to 25. Further, FIG. 23 is an explanatory view illustrating a relation between a voltage change in driving waveform and a pressure fluctuation in the individual liquid chamber, FIG. 24 is a diagram illustrating the pulse interval of the driving waveform, and FIG. 25 is an explanatory view illustrating the pulse interval of the driving waveform.

Figure 24:
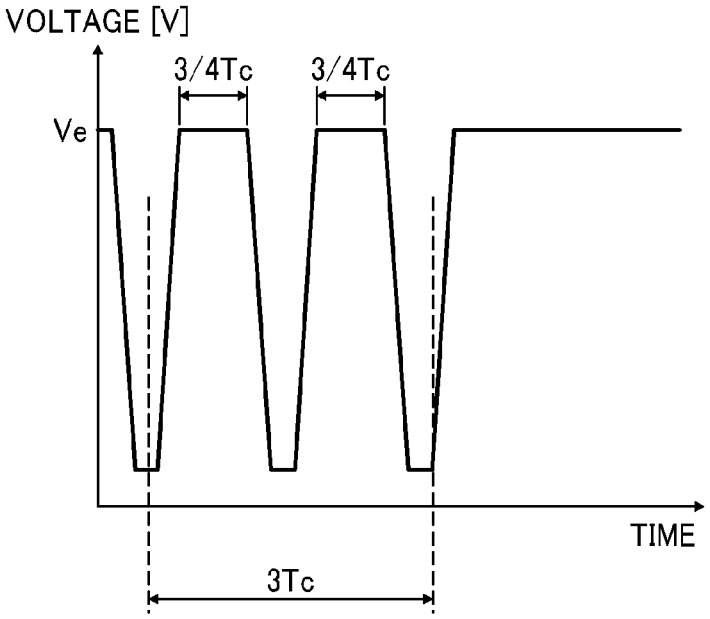
FIG. 24 is an explanatory view illustrating the pulse interval of the driving waveform according an embodiment of the present invention.
Figure 25:
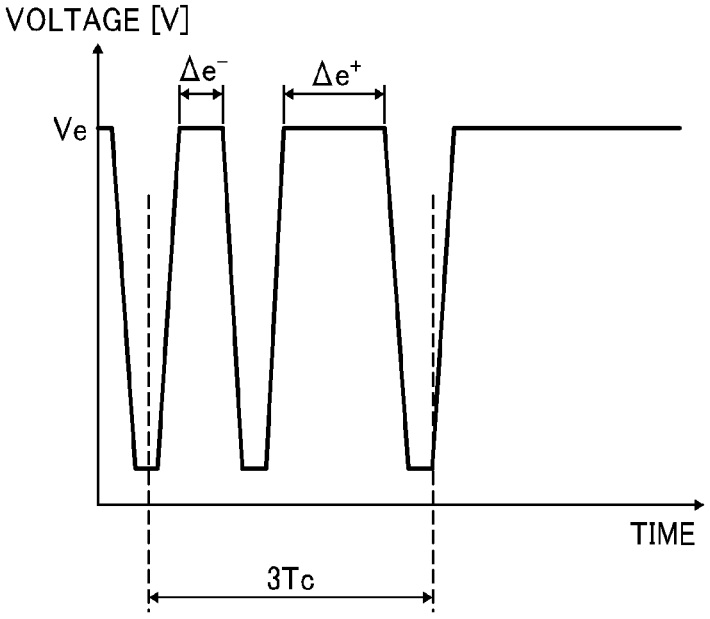
FIG. 25 is an explanatory view illustrating the pulse interval of the driving waveform according an embodiment of the present invention.

For example, as illustrated in FIG. 24, each pulse interval of the three driving pulses P1 to P3 is set as ¾Tc (n=1, n is a natural number). At this time, as illustrated in FIG. 23, for example, when ¾Tc is set the time te, there is no pressure difference between the pressure fluctuations PA and PB caused by the pressure distribution in the common liquid chamber 10 (where, the succeeding drop is delayed in some cases).

Here, as described above, since the time from the start of the pull-in waveform element 'a' of each of the driving pulses P2 and P3 to the end of the push-in waveform element 'c' is set as ¾Tc, the waveform length between the leading driving pulse P1 to the last driving pulse P3 is uniquely set as 3Tc.

While fixing the waveform length at 3Tc, the second driving pulse P2 is moved to the leading driving pulse P1 side.

At this time, as illustrated in FIG. 25, the pulse interval Tn1 between the first driving pulse P1 and the second driving pulse P2 becomes time Δe−, and the pulse interval Tn2 between the second driving pulse P2 and the third driving pulse P3 becomes Δe+.

In this case, the pressure between the driving pulse P1 and the driving pulse P2 becomes B>A, and the pressure between the driving pulse P2 and the driving pulse P3 becomes B<A.

Therefore, as in the aforementioned first embodiment, the mutual effect is canceled, and consequently, the difference in drop velocity Vj between the nozzles decreases.

In the present application, the "apparatus for ejecting liquid" is an apparatus that includes a liquid ejection head or a liquid ejection unit, and drives the liquid ejection head to eject the liquid. The apparatus for ejecting liquid also includes an apparatus which ejects liquid into air or liquid, as well as an apparatus capable of ejecting the liquid to an object to which liquid can adhere.

The "apparatus for ejecting liquid" may also include a member that is associated with feeding, conveyance and ejection of an object to which liquid can adhere and other pre-treatment apparatuses and post-processing apparatuses.

For example, as the "apparatus for ejecting liquid", there are an image forming apparatus as an apparatus which forms an image on sheet by ejecting the liquid, and a stereoscopic molding apparatus (a three-dimensional molding apparatus) which ejects a molding solution to a powder layer obtained by forming the powder in layers in order to mold three-dimensional molded object (three-dimensional molded object).

Further, the "apparatus for ejecting liquid" is not limited to the apparatus in which significant images such as characters and graphics are visualized by the ejected liquid. For example, the apparatus also includes an apparatus obtained by forming a pattern or the like which does not have its own meaning, and an apparatus obtained by molding the three-dimensional image.

The above-mentioned "object to which liquid can adhere" means an object to which the liquid can at least temporarily adhere, an object to which the liquid adheres and is secured, and an object to which liquid adheres and permeates. Specific example thereof includes a recording medium such as paper, recording paper, recording sheet, a film and a cloth, an electronic component such as an electronic substrate and a piezoelectric element, and a medium such as a powder layer (powder layer), an organ model and a test cell. Unless specifically limited, all objects to which liquid adheres are included.

The material of the 'object to which liquid can adhere' may include materials to which liquid can temporarily adhere, such as paper, yarn, fiber, cloth, leather, metal, plastic, glass, wood, and ceramics.

Further, the term 'liquid' includes liquid, treatment liquid, DNA sample, resist, pattern material, binder, molding solution, or solutions containing amino acids, proteins and calcium, dispersion liquid and the like.

Further, the term "apparatus for ejecting liquid" includes an apparatus in which the liquid ejection head and the object to which liquid can adhere are relatively moved, but is not limited thereto. Specific examples thereof include a serial type apparatus for moving the liquid ejection head, and a line-type apparatus which does not move the liquid ejection head.

Further, the term "apparatus for ejecting liquid" includes a treatment liquid application device which ejects treatment liquid to the sheet to apply the treatment liquid to the surface of the sheet for the purpose of modifying the surface of the sheet, and an injection granular which granulates particles of the raw material by injecting the composition solution obtained by dispersing the raw material in the solution via the nozzles.

The term 'liquid ejection unit' is a unit in which functional components and mechanisms are integrated in the liquid ejection head, and is a set of components associated with the ejection of the liquid. For example, the term "liquid ejection unit" includes a unit in which at least one configuration of a head tank, a carriage, a supply mechanism, a maintenance and recovery mechanism, and a main-scanning movement mechanism is combined with the liquid ejection head.

Here, the integration, for example, includes a configuration in which the liquid ejection head and the functional component and mechanism are secured to each other by fastening, bonding and engagement, and a configuration in which one is movably held with respect to the other. Also, the liquid ejection head, the functional components and mechanisms may be attachable and detachable with each other.

For example, as the liquid ejecting unit, there is a unit in which the liquid ejection head and the head tank are integrated with each other. Further, there is a unit in which the liquid ejection head and the head tank are connected to and integrated with each other by a tube or the like. Here, it is also possible to add a unit that includes a filter between the head tank and the liquid ejection head of the liquid ejection unit.

Further, as the liquid ejection unit, there is a unit in which the liquid ejection head and the carriage are integrated with each other.

Further, as the liquid ejection unit, there is a unit in which the liquid ejection head is movably held by a guide member constituting a part of a scanning movement mechanism, and the liquid ejection head and the scanning moving mechanism are integrated. Further, as the liquid ejection unit, there is a unit in which the liquid ejection head, the carriage and the main scanning movement mechanism are integrated.

Further, as the liquid ejection unit, there is a unit in which a cap member as a part of the maintenance and recovery mechanism is secured to the carriage to which the liquid ejection head is attached, and the liquid ejection head, the carriage and the maintenance and recovery mechanism are integrated.

Further, as the liquid ejection unit, there is a unit in which a tube is connected to the liquid ejection head to which the head tank or the flow passage component are attached, and the liquid ejection head and the supply mechanism are integrated.

The main scanning movement mechanism also includes a guide member alone. Further, the supply mechanism also includes a tube alone, and a loading unit alone.

Further, in the terms of the present invention, all of the image formation, recording, character printing, image printing, and molding are synonym.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

The invention claimed is:

1. An apparatus for ejecting liquid, comprising:

a liquid ejection head including:

a plurality of nozzles to eject liquid;

a plurality of individual liquid chambers to which each nozzle leads;

a common liquid chamber to supply liquid to the plurality of individual liquid chambers; and a pressure generator to generate a pressure for pressing liquid in the individual liquid chambers; and a driving waveform generator to generate a driving waveform to be applied to the pressure generator of the liquid ejection head, the driving waveform including a plurality of driving pulses which continuously ejects liquid in time series, wherein $Tn=n\times Tc/2+x0$ is satisfied, when Tn denotes the pulse interval, with n being a natural number, Tc denotes a natural vibration period of the individual liquid chambers, and x0 denotes the time from a first peak of pressure fluctuation in the individual liquid chambers caused by the preceding driving pulse to a first peak of residual pressure fluctuation in the individual liquid chambers due to pressure fluctuation in the common liquid chamber caused by the pressure fluctuation in the individual liquid chambers.

2. The apparatus for ejecting liquid according to claim 1, wherein, when the time x0 is set as $\frac{1}{4}\times Tc$, and the time from the start of the pull-in waveform element to the end of the push-in waveform element of each driving pulse is set as $\frac{3}{4}\times Tc$, $Ttot=n\times(Tc/2)$ is satisfies, with n being a natural number, wherein Ttot denotes a time from the start of the push-in waveform element of the leading driving pulse to the start of the push-in waveform element of the last driving pulse.

3. The apparatus for ejecting liquid according to claim 2, wherein the common liquid chamber has a shape that narrows toward the end thereof.

* * * * *